US006023252A

United States Patent [19]

Yano et al.

[11] Patent Number: 6,023,252

[45] **Date of Patent: *Feb. 8, 2000**

[54] LIQUID CRYSTAL DISPLAY DEVICE

[75] Inventors: Takakazu Yano; Takahiko Sato; Rikoku Nakamura; Shigeru Morokawa, all of Tokorozawa, Japan

[73] Assignee: Citizen Watch Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/539,585

[22] Filed: Oct. 5, 1995

[30] Foreign Application Priority Data

Apr. 5, 1995 [JP] Japan ..... 7-079993

[51] Int. Cl.[7] ..... G09G 5/00

[52] U.S. Cl. ..... 345/1; 345/87; 345/103

[58] Field of Search ..... 345/103, 127, 345/130, 131, 1, 87; 382/358; 340/709, 784

[56] References Cited

U.S. PATENT DOCUMENTS

| | | | |
|---|---|---|---|
| 4,746,981 | 5/1988 | Nadan et al. | 345/127 |
| 4,751,502 | 6/1988 | Ishii et al. | 340/709 |
| 4,845,473 | 7/1989 | Matsuhashi et al. | 340/784 |

FOREIGN PATENT DOCUMENTS

| | | |
|---|---|---|
| 57-68979 | 4/1982 | Japan . |
| 55-79492 | 6/1990 | Japan . |
| 4-60692 | 2/1992 | Japan . |
| 4-205227 | 7/1992 | Japan . |
| 6-282246 | 10/1994 | Japan . |

*Primary Examiner*—Richard A. Hjerpe
*Assistant Examiner*—Ronald Laneau
*Attorney, Agent, or Firm*—Armstrong, Westerman, Hattori, McLeland, & Naughton

[57] ABSTRACT

An LCD device comprising an LCD for changing the size of a displayed unit of pixels by electrically connecting a plurality of display electrodes in parallel with one another for time-sharing matrix driving liquid crystal pixels arranged as a matrix wherein image data is independently inputted into upper and lower half portions of the LCD, a display controller for outputting upper and lower side image data to be displayed on the upper and lower half portions of the LCD and synchronous signals. The LCD device further comprises an upper side image data-holding memory and a lower side image data-holding memory for dividing image data in a given display area from a screenful of image data outputted from the display controller into new upper and lower side image data to be written and held in the upper and lower side image data-holding memories. The upper and lower side image data held in the upper and lower side memories are read out to be repeatedly displayed on the upper and lower half portions of the LCD. As a result, the image from any desired display area of a full-screen area can be enlargedly displayed on a full-screen area of a display with high quality and be easily visible without being discontinuous.

11 Claims, 13 Drawing Sheets

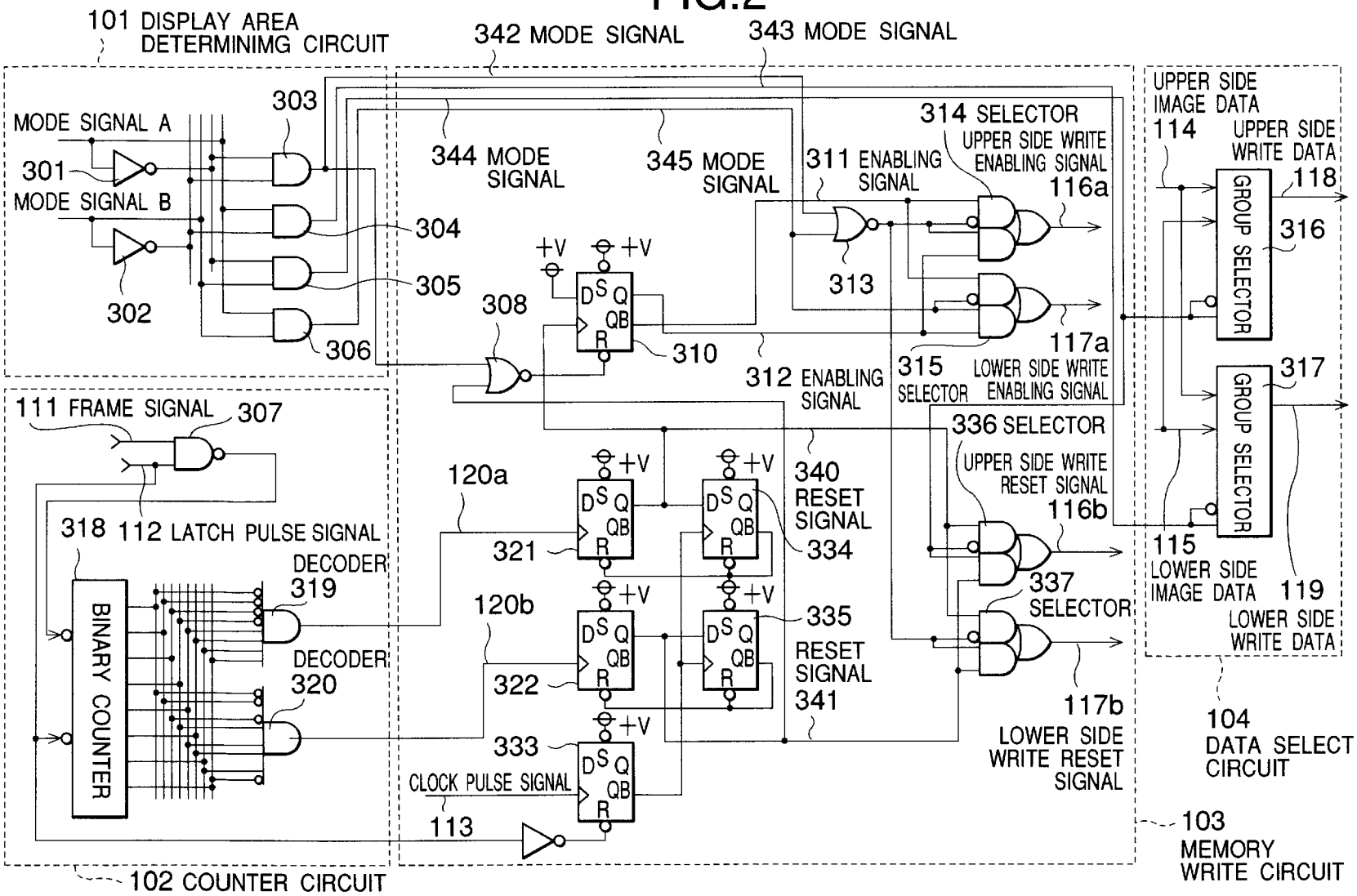
FIG.2
101 DISPLAY AREA DETERMINIMG CIRCUIT
102 COUNTER CIRCUIT
103 MEMORY WRITE CIRCUIT
104 DATA SELECT CIRCUIT
UPPER SIDE IMAGE DATA 114
UPPER SIDE WRITE DATA 118
GROUP SELECTOR 316
GROUP SELECTOR 317
LOWER SIDE IMAGE DATA 115
LOWER SIDE WRITE DATA 119
314 SELECTOR
UPPER SIDE WRITE ENABLING SIGNAL 116a
315 SELECTOR
LOWER SIDE WRITE ENABLING SIGNAL 117a
336 SELECTOR
UPPER SIDE WRITE RESET SIGNAL 116b
337 SELECTOR
LOWER SIDE WRITE RESET SIGNAL 117b
311 ENABLING SIGNAL
312 ENABLING SIGNAL
340 RESET SIGNAL 334
335 RESET SIGNAL 341
343 MODE SIGNAL
342 MODE SIGNAL
345 MODE SIGNAL
344 MODE SIGNAL
CLOCK PULSE SIGNAL 113
MODE SIGNAL A 301
MODE SIGNAL B 302
111 FRAME SIGNAL 307
112 LATCH PULSE SIGNAL
DECODER 319
DECODER 320
318 BINARY COUNTER

FIG. 3

| MODE SIGNAL A | MODE SIGNAL B | DISPLAY AREA | RISE OF WRITE RESET SIGNAL | PERIOD OF WRITE ENABLING SIGNAL | WRITE DATA |
|---|---|---|---|---|---|
| L O W | L O W | 1ST THROUGH 48TH (FULL-SCREEN) | 241ST<br>241ST | STAYS HIGH<br>↑ | UPPER SIDE IMAGE DATA<br>LOWER SIDE IMAGE DATA |
| H I G H | L O W | 1ST THROUGH 240TH (UPPER HALF PORTION) | 241ST<br>120TH | 241ST THROUGH 120TH<br>120TH THROUGH 240TH | UPPER SIDE IMAGE DATA<br>UPPER SIDE IMAGE DATA |
| L O W | H I G H | 241ST THROUGH 480TH (LOWER HALF PORTION) | 120TH<br>241ST | 120TH THROUGH 240TH<br>241ST THROUGH 120TH | LOWER SIDE IMAGE DATA<br>LOWER SIDE IMAGE DATA |
| H I G H | H I G H | 121ST THROUGH 360TH (CENTRAL PORTION) | 120TH<br>241ST | 120TH THROUGH 240TH<br>241ST THROUGH 120TH | UPPER SIDE IMAGE DATA<br>LOWER SIDE IMAGE DATA |

UPPER ROW : UPPER SIDE CONTROL LOWER ROW : LOWER SIDE CONTROL

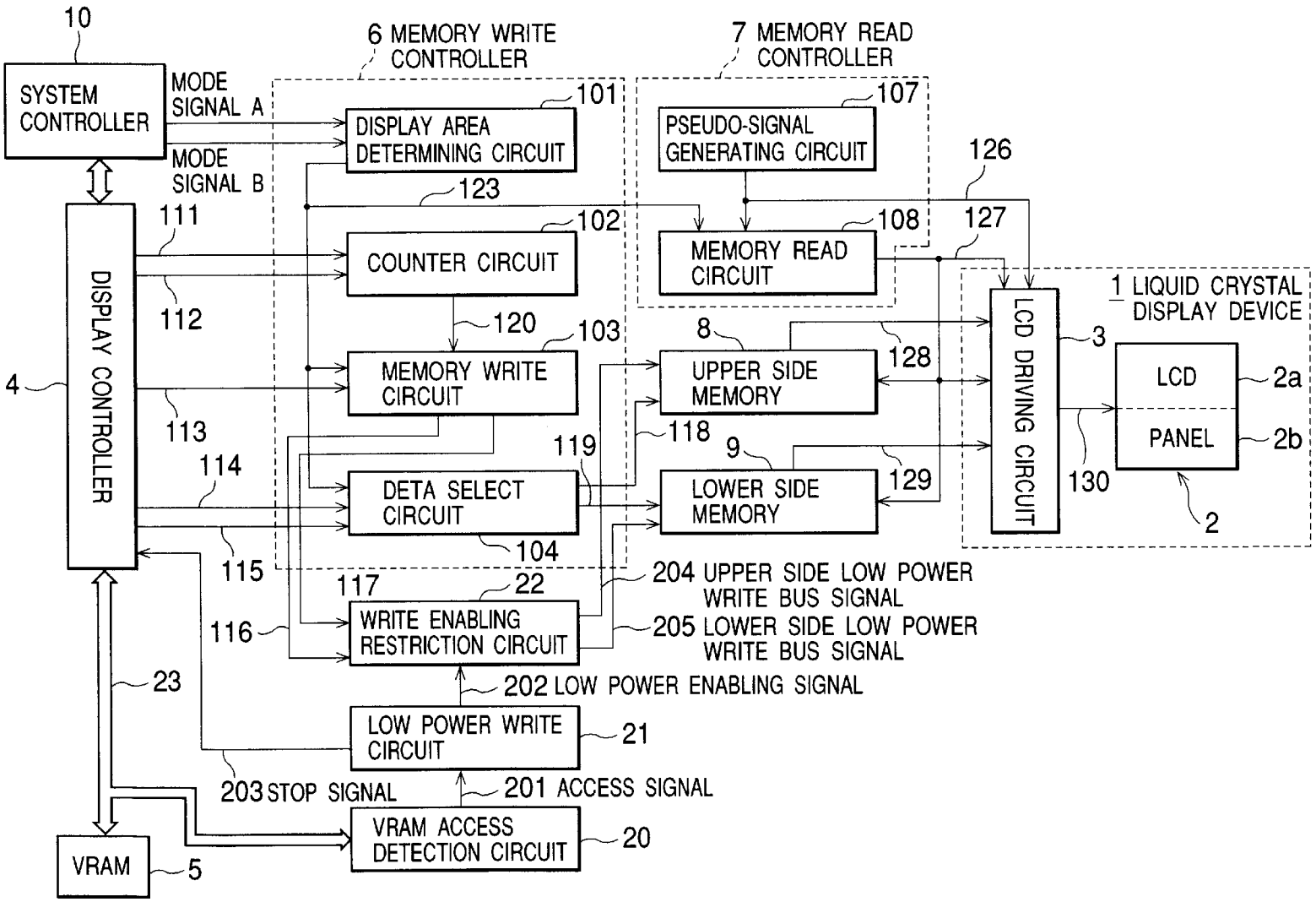
FIG.6
1 LIQUID CRYSTAL DISPLAY DEVICE
LCD
PANEL
2a
2b
2
LCD DRIVING CIRCUIT
3
130
126
127
7 MEMORY READ CONTROLLER
PSEUDO-SIGNAL GENERATING CIRCUIT
107
MEMORY READ CIRCUIT
108
128
129
UPPER SIDE MEMORY
8
LOWER SIDE MEMORY
9
118
204 UPPER SIDE LOW POWER WRITE BUS SIGNAL
205 LOWER SIDE LOW POWER WRITE BUS SIGNAL
202 LOW POWER ENABLING SIGNAL
201 ACCESS SIGNAL
6 MEMORY WRITE CONTROLLER
DISPLAY AREA DETERMINING CIRCUIT
101
123
COUNTER CIRCUIT
102
120
MEMORY WRITE CIRCUIT
103
119
DETA SELECT CIRCUIT
104
22
WRITE ENABLING RESTRICTION CIRCUIT
117
LOW POWER WRITE CIRCUIT
21
VRAM ACCESS DETECTION CIRCUIT
20
203 STOP SIGNAL
MODE SIGNAL A
MODE SIGNAL B
111
112
113
114
115
116
23
SYSTEM CONTROLLER
10
DISPLAY CONTROLLER
4
VRAM
5

LIQUID CRYSTAL DISPLAY DEVICE

BACKGROUND OF THE INVENTION

1. Field of the Invention

The present invention relates to a liquid crystal display device used for a portable personal computer, etc. particularly to a liquid crystal display device having a magnifying or enlarging display function.

2. Description of Prior Arts

A liquid crystal display device is employed as a display device of various electronic devices such as a laptop-type or a note-book-type portable personal computer, a word processor, a portable TV, a video camera or the like since it is thin, light and consumes little power.

Such a liquid crystal display device (LCD device) generally comprises a liquid crystal display (LCD) composed of a liquid crystal display panel (LCD panel) provided with a plurality of liquid crystal pixels arranged as a matrix and display electrodes corresponding to the liquid crystal pixels and a driving circuit for driving the liquid crystal pixels under time-sharing control, namely, for time-sharing matrix driving the liquid crystal pixels by successively applying control signals corresponding to the image data to the display electrodes forming each line of the image data; and, a display controller for outputting the image data and synchronous signals to the driving circuit.

Moreover, such an LCD device has enlarging function, which is not only effective in fine visibility but also in improvement of contrast or reduction of power consumption.

As a result, enlarging display methods have been proposed using the LCD device.

For example, Japanese Patent Laid-Open Publication No. 55-79492 discloses an enlarging display method comprising applying the same driving signal to a plurality of display electrodes in a bunch or unit so as to change the size of the displayed unit of pixels to thereby enlarge a display area. Furthermore, Japanese Patent Laid-Open Publication No. 57-68979 discloses a method of enlarging the display area by N times by increasing the frequency of a scanning clock by N times for time-sharing matrix driving of liquid crystal pixels of an LCD device, and a method of changing display areas by delaying reference signals.

Such conventional enlarging display methods, however, cannot enlargedly display an image from any desired display area of a full-screen area of a display, but normally only an image from, e.g. an upper screen area, can be enlargedly displayed on a full-screen area of a display.

Still furthermore, there is an LCD of a vertically-divided driving system shown in FIG. 14, wherein image data is inputted independently to upper and lower half portions of the LCD.

According to this example, an LCD 1 is provided with an LCD panel 2, which can display image data corresponding to 400 rows of pixels (hereinafter referred to as 400 lines of image data). The LCD 1 independently comprises a 4-bit parallel-input upper data bus 12 for transferring upper side image data corresponding to 200 rows of pixels extending from the 1st through 200th rows (hereinafter referred to as the 1st through 200th image data lines) to be displayed on an upper half portion 2*a* of the LCD panel 2, and a 4-bit parallel-input lower data bus 13 for transferring a lower side image data corresponding to 200 rows of pixels extending from 201st through 400th rows (hereinafter referred to as 201st through 400th image data lines) to be displayed on a lower half portion 2*b* of the LCD panel 2.

Synchronous signals for scanning and time-sharing matrix driving each liquid crystal pixel are inputted into the upper half portion 2*a* and the lower half portion 2*b* by way of the same bus, i.e., a synchronous bus 14 wherein both upper and lower half portions 2*a* and 2*b* are scanned at the same time 200 times per cycle, thereby displaying 400 lines of image data extending from the 1st through 400th lines image data.

Such an LCD had a problem in that when an image from any desired display area of a full-screen area is to be enlarged, the image data is not equally divided into upper and lower side image data so that the enlarged image becomes discontinuous or uneven.

SUMMARY OF THE INVENTION

It is an object of the present invention to solve these problems and provide an LCD device comprising an LCD for changing the size of the displayed unit of pixels by electrically connecting a plurality of display electrodes in parallel with one another for time-sharing matrix driving liquid crystal pixels arranged as a matrix wherein image data is independently inputted into upper and lower half portions of the LCD, a display controller for outputting upper and lower side image data to be displayed on the upper and lower half portions of the LCD, and synchronous signals, wherein an image from any desired display area of a full-screen area can be enlargedly displayed on a full-screen area of the display with high quality and be easily visible without being discontinuous.

In order to achieve the above object, the LCD device according to the present invention comprises upper and lower side image data-holding memories.

The LCD device further comprises a memory write control means which divides image data from a given display area of a full-screen area outputted from the display controller into new upper and lower side image data and writes the same in the upper and lower side image data-holding memories to be held therein respectively.

The LCD device still further comprises a memory read control means for reading out the upper and lower side image data to be displayed repeatedly on the upper and lower half portions of the LCD respectively.

According to the LCD device having such a structure as mentioned above, if the given display area described above becomes a full-screen area, upper and lower side image data from the full screen area outputted from the display controller are written in the upper and lower side image data-holding memories as they are new upper and lower side image data to be held therein respectively, and thereafter are read out therefrom to be displayed on the upper and lower screen areas respectively without electrically connecting the display electrodes of the LCD in parallel with one another, thereby displaying a normal equal-sized image.

If the given display area described above is a vertical segment of a belt-shaped display area extending in a horizontal direction of the full screen area, image data from the belt-shaped display area in a screenful of image data output from the display controller is divided into new upper and lower side image data, which are written in the upper and lower side image data-holding memories set forth above to be held therein respectively. They are then read out therefrom to be displayed as a normally enlarged image by scanning the display electrodes which are electrically connected in parallel with one another, and which correspond to a plurality of liquid crystal pixels which are contiguous with one another in a vertical direction of the screen of the LCD.

It is preferable that the above memory write control means comprises a display area determining means for determining the given display area, a write reference determining means for determining a write reference based on the synchronous signals outputted from the display controller, a write means for controlling the upper and lower side image data-holding memories based on the signals outputted from the write reference determining means and the display area determining means, and a select means for selecting the upper and lower side image data outputted from the display controller in response to the signals outputted from the display area determining means to output the same as new upper and lower side image data which are written in the upper and lower side image data-holding memories respectively.

The display area determining means selects any of a plurality of different display areas which have been previously set in response to inputted mode signals and determines the same as the given display area.

Otherwise, it is also possible to detect a cursor location representing ready for input of image data in a full screenful image data outputted from the display controller and determine a given area including the detected cursor location as the given display area. This method is convenient for personal computers, word processors or the like since an area in which characters etc. to be inputted next are displayed is automatically enlargedly displayed.

When the display controller is operating, the image data of the given display area in the image data outputted thereby are written in the upper and lower side image data-holding memories to be held therein as described above, and when the display controller is not operating (e.g., when the system is ready for input while it is driven with low power consumption), the upper and lower side image data stored in the upper and lower side image data-holding memories respectively can be read out therefrom to be repeatedly displayed on the upper and lower half portions of the LCD device.

Accordingly, even in a state of being ready for input wherein the display controller stops its operation, it is possible to continue displaying the image of the full-screen area which was most recently outputted as a static image with an equal-sized image or enlargedly displaying the image from a part of the full-screen area which was most recently outputted as a static image with an enlarged image on a part of the display area.

When the display controller is operating, the image data from any given display area of the image data outputted from the display controller can be repeatedly written in the upper and lower side image data-holding memories and be read out therefrom to be repeatedly displayed on the upper and lower half portions of the LCD device respectively so as to be displayed in real time as an equal-sized image or an enlarged image.

To achieve the objects of the invention, the present invention may be provided with a data converting means for converting image data from a given display area of upper and lower side image data outputted from the display controller into new upper and lower side image data to be inputted into the upper and lower side image areas in the LCD so as to enlargedly display upper and lower half portions of image data from a given area of a screenful of image data output from the display controller on upper and lower half screens of the LCD.

In this case, the aforementioned given display area can be selected from and determined by any of a plurality of different display areas which have been previously set in response to inputted mode signals.

Further, a cursor location in a screenful of image data output from the display controller is detected and an area having a given range including the detected cursor location may be determined as the given display area.

The above and other objects, features and advantages of the invention will be apparent from the following detailed description which is to be read in conjunction with the accompanying drawings.

BRIEF DESCRIPTION OF THE DRAWINGS

FIG. 2 is a circuit diagram showing details of the memory write control portion in FIG. 1;

FIG. 3 is a table for explaining the operation of the memory write control portion shown in FIG. 2;

FIG. 6 is a block diagram of an LCD device according to a second embodiment of the present invention;

DETAILED DESCRIPTION OF THE PREFERRED EMBODIMENTS

The preferred embodiments of the present invention will be described hereinafter with reference to drawings.

Figure 1:
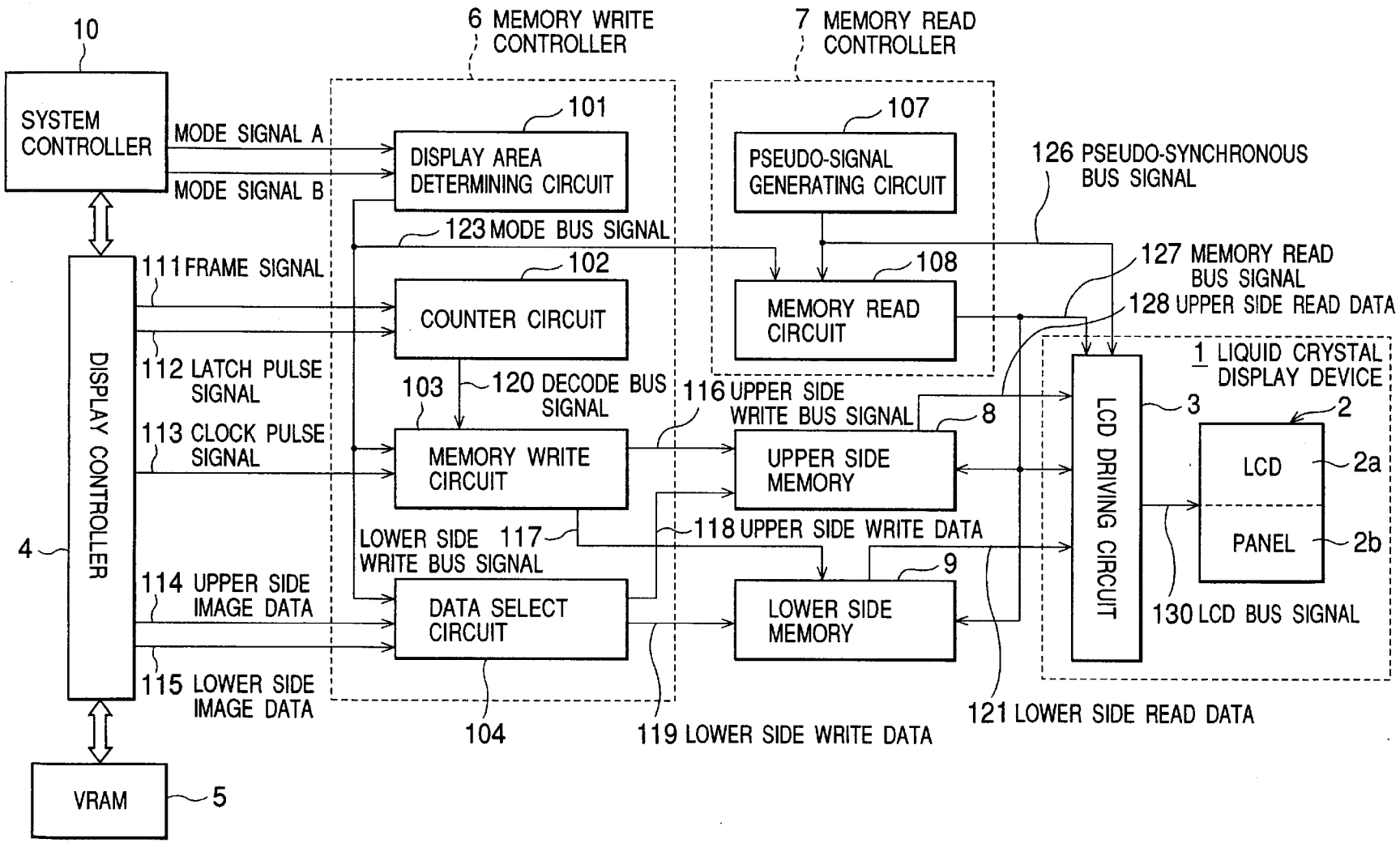
FIG. 1 is a block circuit diagram of an LCD device according to a first embodiment of the present invention.

FIG. 1 is a block circuit diagram of an LCD device according to a first embodiment of the present invention.

Figure 14:
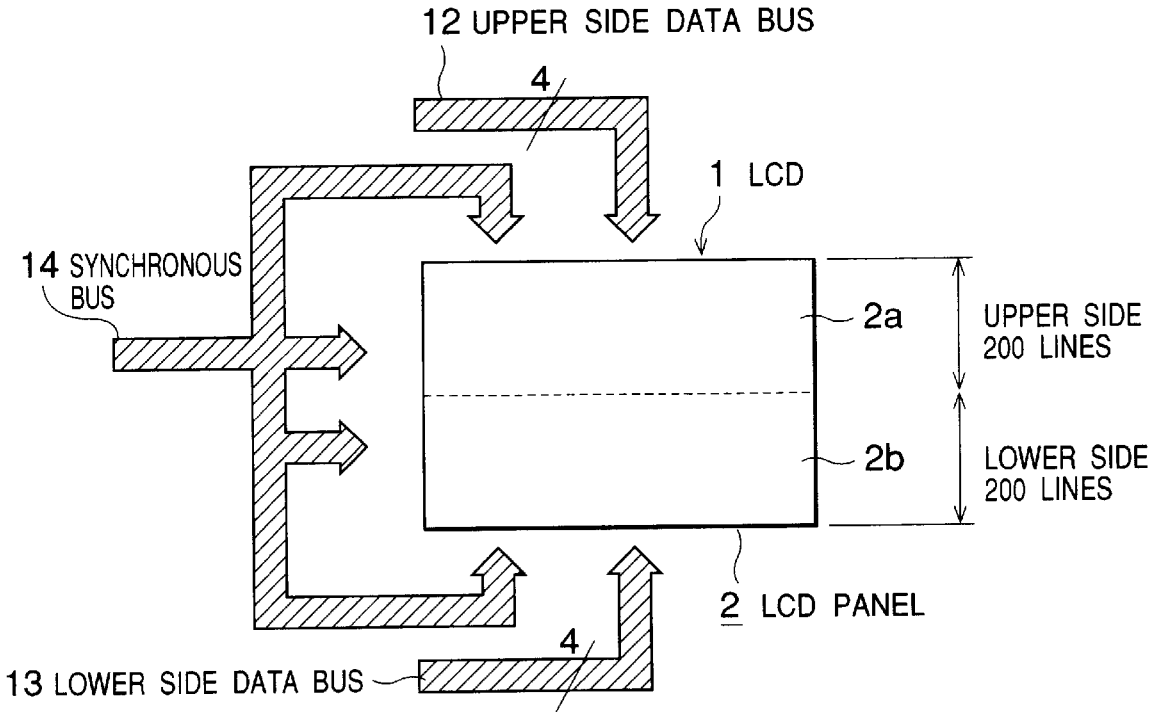
PRIOR ART FIG.14
FIG. 14 is a schematic view of a conventional LCD device of a vertically-divided driving system.

In the first embodiment, denoted at 1 is an LCD device which employs a VGA (Video Graphic Array) of the vertically-divided driving system wherein vertically divided image data is inputted in the same manner as a conventional LCD device shown in FIG. 14. The LCD device of this type is, for example, employed by personal computers or the like, and it is composed of an LCD panel 2 including 640 by 480 liquid crystal pixels and display electrodes corresponding thereto respectively arranged as a matrix, and an LCD driving circuit 3 for independently time-sharing matrix driving the upper and lower half portions 2*a* and 2*b* of the LCD panel 2.

A display controller 4 is a display controller circuit using a microcomputer which is a usual VGA controller. The display controller 4 accesses a VRAM (Video RAM) 5 to write display data transferred from a system controller 10 therein upon receipt of an instruction from the system controller 10. The display controller 4 reads out the display data written in the VRAM 5, and outputs a frame signal 111, a horizontal latch pulse signal 112, a clock pulse signal 113, respectively serving as synchronous signals for driving the LCD device, and upper and lower side image data 114 and 115. It is supposed that the display controller 4 outputs 241 lines of image data on each of an upper and a lower side.

The VRAM 5 is a buffer memory for the display data, and employs a normal SRAM (Static RAM) or DRAM (Dynamic RAM).

The system controller 10 is a control portion for controlling an entire system of such a device as a personal computer or a word processor provided with the LCD device, and includes microcomputers. The system controller 10 is connected to an input device such as a keyboard and a storage device such as a hard disk device and a floppy disk by way of an I/O circuit so as to perform various processings including data processing, and various controlling, to prepare necessary display data which are transferred to the display controller 4 to be written in the VRAM 5. Mode signals A and B, described later, are outputted from the system controller 10 by instruction of an operator or automatically.

The LCD device of the first embodiment further comprises a memory write controller (memory write control means) 6, a memory read controller (memory read control means) 7, an upper side memory 8 serving as an upper side image data-holding memory, and a lower side memory 9 serving as a lower side image data-holding memory.

The memory write controller 6 comprises a display area determining circuit 101, a counter circuit 102 serving as a write reference determining means, a memory write circuit 103 serving as a write means, and a data select circuit 104 serving as a select means.

The display area determining circuit 101 is a circuit for determining a display area in which a screenful of image data outputted from the display controller 4 is displayed normally or enlargedly, and also it is a circuit to transmit the result of decoding of the mode signals A and B which are inputted from the system controller 10 to the memory write circuit 103, the data select circuit 104 and a memory read circuit 108, described later, as a mode bus signal 123 corresponding to a display area determining signal.

It should be noted that in this specification the term "screenful of image data" refers to an amount or quantity of data corresponding to one full screen's worth of image data. In other words, one full screen of image data is a screenful of image data.

The mode signals A and B can also be directly and selectively produced by an operator by way of dip switches, etc., provided in the LCD device.

The counter circuit 102 produces a decode bus signal 120, based on which the image data is written in the upper and lower side memories 8 and 9, in response to the frame signal 111 and the horizontal latch pulse signal 112 outputted from the display controller 4 as synchronous signals.

The memory write circuit 103 is a circuit for producing an upper side write bus signal 116 for driving the upper side memory 8 to write the image data therein, and a lower side write bus signal 117 for driving the lower side memory 9 to write the image data therein in response to the decode bus signal 120 and the clock pulse signal 113.

The data select circuit 104 selects the upper and lower side image data 114 and 115 respectively outputted from the display controller 4 to thereby output upper side write data 118 serving as a new upper side image data to be written in the upper side memory 8 and lower side write data 119 serving as new lower side image data to be written in the lower side memory 9 in response to the mode bus signal 123 outputted from the display area determining circuit 101.

The memory read controller 7 comprises a pseudo-signal generating circuit 107 and a memory read circuit 108.

The pseudo-signal generating circuit 107 is a circuit for producing a pseudo-synchronous bus signal 126 serving as a synchronous signal corresponding to the frame signal 111, the horizontal latch pulse signal 112 and the clock pulse signal 113 for driving the LCD 1 upon reception of a pseudo-clock signal 125 which is produced by a pseudo-clock generating circuit, not shown.

The memory read circuit 108 is a circuit for producing a memory read bus signal 127 serving as a driving signal for reading out the image data which are held in the upper and lower side memories 8 and 9 in response to the pseudo-synchronous bus signal 126.

The upper and lower side memories 8 and 9 are FIFO field memories.

The LCD driving circuit 3 is a circuit for producing an LCD bus signal 130 to drive each liquid crystal pixel of the upper and lower half portions 2*a* and 2*b* of the LCD panel 2 in response to the pseudosynchronous bus signal 126, upper and lower side read data 128 and 129, and it includes a booster circuit, etc.

FIG. 2 is a detailed circuit diagram of the memory write controller 6 in FIG. 1.

The display area determining circuit 101 comprises two inverters 301 and 302, four AND gates 303 through 306, and interconnection circuits thereof.

In this embodiment, display areas previously determined by the mode signals A and B inputted from the system controller 10 are shown in FIG. 3.

That is, in case of a normal display mode for normally displaying an image of a full-screen area (1st through 480th image data lines) on a full-screen area of a display, the mode signals A and B go low level (hereafter simply referred to as go low) so that only the AND gate 303 of the four AND gates 303 through 306 of the display area determining circuit 101 outputs a mode signal 342 of high level.

In case of an enlarged display mode for enlargedly displaying an image of a part of the full-screen area on a full-screen area of a display, the display area determining circuit 101 operates as follows.

When an image of an upper screen area (1st through 240th image data lines) is displayed on a full-screen area of a display, the mode signal A goes high (hereinafter referred to as simply goes high) and the mode signal B goes low so that only the AND gate 304 outputs a mode signal 343 of high level.

When an image of a lower screen area (241st through 480th image data lines) is displayed on a full-screen area of a display, the mode signal A goes low and the mode signal B goes high so that only the AND gate 305 outputs a mode signal 344 of high level.

When an image of a central screen area (121st through 360th image data lines) is displayed on a full-screen area of a display area, the mode signals A and B go high so that only the AND gate 306 outputs a mode signal 345 of high level.

These mode signals 342 through 345 constitute the mode bus signal 123 in FIG. 1.

The counter circuit 102 comprises a NAND gate 307, a binary counter 318, two decoders 319 and 320, and interconnection circuits thereof.

The binary counter 318 receives the horizontal latch pulse signal 112 as its input clock and also receives an output signal of the NAND gate 307 as its reset signal wherein the NAND gate 307 receives the frame signal 111 and the horizontal latch pulse signal 112, and counts the horizontal latch pulse signal 112. When a counted value of the binary counter 318 is "241", a decode signal 120*a* which is an output of the decoder 319 goes high, while when a counted value of the binary counter 318 is "120", a decode signal 120*b* which is an output of the decoder 320 goes high.

The memory write circuit 103 comprises NOR gates 308 and 313, D flip-flop circuits (hereinafter referred to as DFF) 310, 321, 322, 333, 334 and 335, selectors 314, 315, 336 and 337, and interconnection circuits thereof.

The DFFs 321 and 334 produce a reset signal 340 which goes high in response to the decode signal 120*a* of high level inputted from the decoder 319 when the counted value of the binary counter 318 of the counter circuit 102 is "241" and goes low in synchronization with the rise of a second clock pulse signal 113 based on the horizontal latch pulse signal 112.

The DFFs 322 and 335 go high in response to the decode signal 120*b* of high level which is inputted from the decoder 320 when the counted value of the binary counter 318 of the counter circuit 102 is "121" so that they produce a reset signal 340 in synchronization with the rise of the second clock pulse signal 113 counting from the horizontal latch pulse signal 112.

The selector 336 outputs an upper side write reset signal 116*b* or the selector 337 outputs a lower side write reset signal 117*b* in accordance with FIG. 3.

The NOR gate 308 and the DFF 310 produce an enabling signal 311 or 312 which goes high when the counted value of the binary counter 318 is "241" and goes low when the counted value of the binary counter 318 is "121" in a state where the mode signal 342 is low. The enabling signal 311 goes high and the enabling signal 312 goes low when the mode signal 342 is high.

The NOR gate 313 and the selectors 314 and 315 output the enabling signal 311 as an upper side write enabling signal 116*a* or the enabling signal 312 as a lower side write enabling signal 117*a* in accordance with FIG. 3.

The data select circuit 104 comprises group selectors 316 and 317. The group selector 316 switches between the upper and lower side image data 114 and 115 so as to produce the upper side write data 118 while the group selector 317 switches between the upper and lower side image data 114 and 115 so as to produce the lower side write data 119 in accordance with FIG. 3.

The switching between the upper and lower side image data 114 and 115 by the data select circuit 104 can be performed when the mode signal 343 is high (enlarged display mode for enlargedly displaying the upper screen area on a full-screen area of a display) and the mode signal 344 is high (enlarged display mode for enlargedly displaying the lower screen area on the full-screen area of a display).

Figure 4:
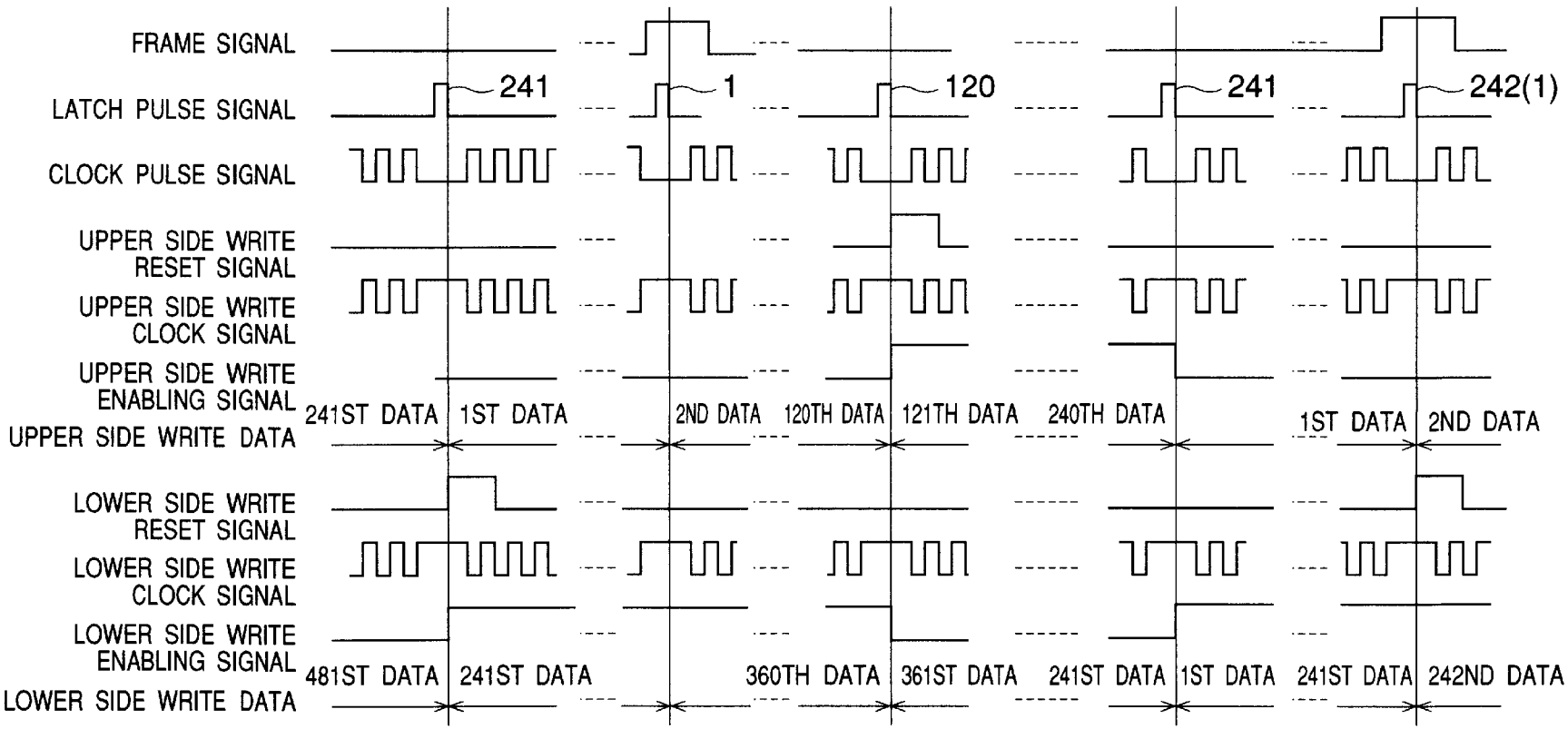
FIG. 4 is a timing chart of signals for explaining the operation of the memory write control portion shown in FIG. 2.

FIG. 4 is a timing chart of writing signals into the memory for enlargedly displaying the 121st through 360th image lines on a full-screen area of display using a bundle function for electrically connecting a plurality of display electrodes in parallel with one another which electrodes correspond to liquid crystal pixels which are vertically contiguous with one another on a full-screen area of the LCD panel 2.

In FIG. 4, the frame signal 111 is a signal forming a base of a frame and corresponds to a vertical synchronous signal. The horizontal latch pulse signal 112 is a signal forming a base for scanning the LCD 1 and for displaying the image data and corresponds to a horizontal synchronous signal.

The upper side write reset signal 116*b* is a signal based on which the data is written in the upper side memory 8, and it is high and active. An upper side write clock signal is a signal based on which the image data is written in the upper side memory 8 when it rises.

The upper side write enabling signal 116*a* is a signal for setting a period when the image data is written in the upper side memory 8, and it is high and active. These upper side write reset signal 116*b*, the write clock signal, and the upper side write enabling signal 116*a* correspond to the upper side write bus signal 116 in FIG. 1. The upper side write data 118 is a write data signal based on which the image data is written in the upper side memory 8.

The lower side write reset signal 117*b* is a signal based on which the image data is written in the lower side memory 9, and it is high and active. The lower side write clock signal is a signal based on which the image data is written in the lower side memory 9 when it rises.

The lower side write enabling signal 117*a* is a signal for setting a period when the image data is written in the lower side memory 9, and it is high and active.

The lower side write reset signal 117*b*, the lower write clock signal, and the lower side write enabling signal 117*a* correspond to the lower side write bus signal 117 in FIG. 1. The lower side write data 119 is a write data signal based on which the image data is written in the lower side memory 9.

In order to enlargedly display the 121st through 360th image data lines on a full-screen area of display using the bundle function, the 121st through 240th image data lines are held in the upper side memory 8 while the 241st through 360th image data lines may be held in the lower side memory 9.

Accordingly, the upper side write reset signal 116*b* is made active in synchronization with the fall of the 120th horizontal latch pulse signal 112 after the time when the frame signal 111 is made active. The upper side write enabling signal 116*a* is made active in synchronization with the fall of the 120th horizontal latch pulse signal 112 after the time when the frame signal 111 is made active, and is made inactive in synchronization with the fall of the 241st horizontal latch pulse signal 112. The upper side write data 118 remains to be the upper side image data 114.

The lower side write reset signal 117*b* is made active in synchronization with the fall of the 241st horizontal latch pulse signal 112 after the time when the frame signal 111 is made active. The upper side write enabling signal 117*a* is made active in synchronization with the fall of the 241st horizontal latch pulse signal 112 after the time when the frame signal 111 is made active, and is made inactive at the same time when the 120th horizontal latch pulse signal 112 falls. The lower side write data 119 remains to be lower side image data 115.

Figure 5:
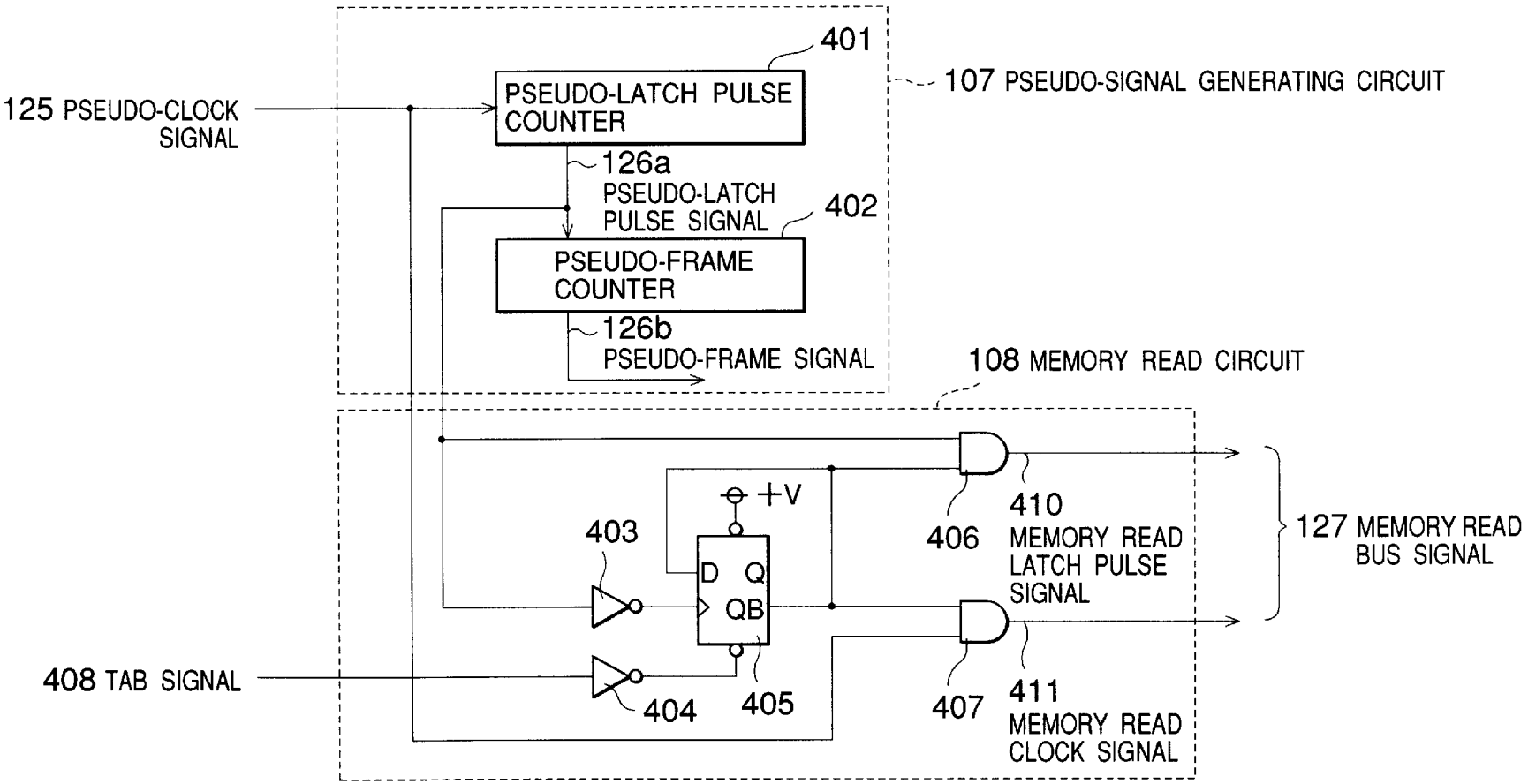
FIG. 5 is a circuit diagram showing details of the memory write control portion in FIG. 1.

Details of the memory read controller 7 in FIG. 1 are shown in FIG. 5.

The pseudo-signal generating circuit 107 comprises a pseudo-latch pulse counter 401 and a pseudo-frame counter 402. The pseudo-latch pulse counter 401 counts the pseudo-clock signal 125 to thereby output a pseudo-latch pulse signal 126*a*. The pseudo-frame counter 402 counts the pseudo-latch pulse signal 126*a* to thereby output a pseudo-frame signal 126*b*. The pseudo-latch pulse signal 126*a* and the pseudo-frame signal 126*b* constitute the pseudo-synchronous signal in FIG. 1 together with the pseudo-clock signal 125.

The memory read circuit 108 comprises inverters 403 and 404, a DFF 405, and AND gates 406 and 407.

The DFF 405 is a circuit for dividing a frequency of the pseudo-latch pulse signal 126*a* by 2 which is inputted by way of the inverter 403 when a signal, which is obtained by inverting a TAB signal 408 by the inverter 404, is low, wherein the TAB signal 408 goes high when either of the display areas is instructed to be enlargedly displayed on a full-screen area of the display in response to the mode bus signal 123 outputted from the display area determining circuit 101 in FIG. 1, for example, to be double enlargedly displayed.

The AND gate 406 is a circuit for outputting a memory read latch pulse signal 410 which is obtained when a QB output of the DFF 405 and the pseudo-latch pulse signal 126*a* are ANDed. The AND gate 407 is a circuit for outputting a memory read clock signal 411 which is obtained when the QB output of the DFF 405 and the pseudo-clock signal 125 are ANDed.

That is, in the enlarged display mode, the pseudo-latch pulse signal 126*a* and the pseudo-clock signal 125 are divided in frequency corresponding to the number of parallel connections of the display electrodes for time-sharing matrix dividing the liquid crystal pixels of the LCD 1 so as to output the memory read latch pulse signal 410 and the memory read clock signal 411. Since the number of parallel connections of the display electrodes is 2 at a double magnifying ratio, the pseudo-latch pulse signal 126*a* and the pseudo-clock signal 125 are divided in frequency by 2 so that their periods become half.

The memory read latch pulse signal 410 and the memory read clock signal 411 constitute a memory read bus signal to be inputted into the upper and lower side memories 8 and 9 and the LCD driving circuit 3 in FIG. 1. When cycles of the memory read latch pulse signal 410 and the memory read clock signal 411 are made long, power consumption can be reduced.

According to the first embodiment, when displaying image data on the LCD 1 having 640 by 480 liquid crystal pixels, the 1st through 240th image data lines and the 241st through 480th image data lines are different from each other as shown in FIG. 4, so that the vertically-divided driving system is employed for independently driving the upper and lower portions of the LCD panel 2.

Accordingly, for example, in case of double enlarged display in the vertical direction, when the 121st through 360th image data lines (central portion) are enlargedly displayed on a full-screen area of a display, the 121st through 240th image data lines are displayed on the upper half portion 2*a* of the LCD panel 2, and the 241st through 240th image data lines are displayed on the lower half portion 2*b* of the LCD panel 2.

Therefore, the upper and lower side memories 8 and 9 are provided as buffer memories for holding the upper and lower side image data, wherein the upper side memory 8 holds the 121st through 240th image data lines to be read out therefrom and repeatedly displayed on the upper half portion 2*a* of the LCD panel 2, and the lower side memory 9 holds the 241st through 360th image data lines to be read out therefrom and repeatedly displayed on the lower half portion 2*b* of the LCD panel 2.

In this case, the display electrodes of the liquid crystal pixels of the LCD 1 are scanned in a state where they are connected with one another two by two each of which are vertically contiguous with each other, so that the same image data are displayed on two vertically contiguous lines.

In such a manner, the image data from the given display area outputted by the display controller 4 is enlargedly displayed on a full-screen of the LCD 1 so that the image data can be displayed to be easily visible without being discontinuous and uneven.

This is applied when the image data from other display areas is enlargedly displayed on a full-screen area of a display. When the 1st through 240th image data lines (upper screen area) are enlargedly displayed, the image data in the full-screen area are all image data from the upper screen area. However, the 1st through 120th image data lines are written in the upper side memory 8 as the upper side write data (new upper side image data), and the 121st through 240th image data lines are written in the lower side memory 9 as the lower side write data (new lower side image data).

When the 241st through 480th image data lines (lower screen area) are enlargedly displayed on a full-screen area of a display, the 241st through 360th image data lines are written in the upper side memory 8 as the upper write data (new upper side image data) and the 361st through 480th image data lines are written in the lower side memory 9 as the lower write data (new lower side image data) although the image data displayed in the full-screen area are all the lower side image data.

As mentioned above, the image data from the given display area is equally divided into the new upper and lower side image data and the thus divided upper and lower side image data are held in the upper and lower side memories 8 and 9 to be read out therefrom, then enlargedly displayed double in the vertical direction on the upper and lower half portions 2*a* and 2*b* of the LCD panel 2, whereby the image data from any of the given areas of a full-screen area outputted from the display controller 4 is enlargedly displayed in the full-screen area of a display so that it can be displayed to be easily visible without being discontinuous and uneven.

A second embodiment of the present invention will be now described. FIG. 6 is a block circuit diagram of an LCD device in which elements which are the same as those of the first embodiment are denoted at the same numerals and explanations thereof are omitted.

According to the second embodiment, the present invention is applied to a low power consumption display system disclosed in, e.g. Japanese Patent Laid-Open Publication Nos. 4-60692 and 4-205227.

In the second embodiment, a VRAM access detection circuit 20, a low power write circuit 21 and a write enabling restriction circuit 22 are provided in addition to the elements of the first embodiment shown in FIG. 1.

The VRAM access detection circuit 20 is a detection circuit for detecting whether the display controller 4 is operating or not by detecting whether the display controller 4 accesses the VRAM 5 or not. When the VRAM access detection circuit 20 detects that the display controller 4 accesses the VRAM 5, it makes the access signal 201 low. The low power write circuit 21 makes a low power enabling signal 202 high when an access signal 201 from the VRAM access detection circuit 20 goes low so as to permit the write enabling restriction circuit 22 to enable the memory write circuit 103. The low power write circuit 21 makes a stop signal 203 low after the lapse of a write period when at least one frame of image data is written so as to stop the operation of the display controller 4.

The write enabling restriction circuit 22 restricts active periods of the upper and lower side write bus signals 116 and 117 in response to the low power enabling signal 202 from the low power write circuit 21 so as to output upper and lower side low power write bus signals 204 and 205 only at the time when the display controller 4 is operating and the low power enabling signal 202 is high.

Figure 7:
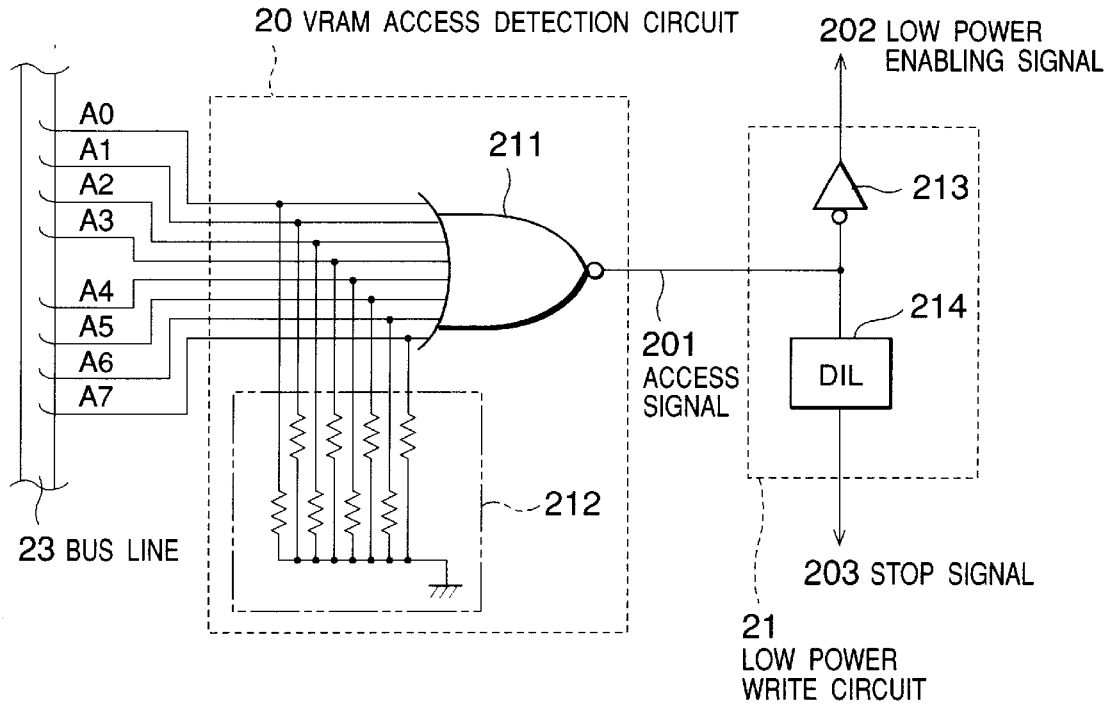
FIG. 7 is a circuit diagram showing examples of a VRAM access detection circuit and a low power write circuit in FIG. 6.

Simple and detailed circuit diagrams of the VRAM access detection circuit 20 and the low power write circuit 21 are shown in FIG. 7.

The VRAM access detection circuit 20 comprises a NOR gate 211 which receives address signals A0 through A7 by way of an address bus of a bus line 23 for connecting the display controller 4 and the VRAM 5, and a pull down resistor array 212, and it judges that the display controller 4 is operating to access the VRAM 5 when at least one of the address signals A0 through A7 is high so as to make the access signal 201 serving as an output thereof low.

The VRAM access detection circuit 20 judges that the display controller 4 is operating or not to access the VRAM 5 when all the address signals A0 through A7 are low so as to make the access signal 201 as an output thereof high. The pull down resistor array 212 is a pull down resistor group relative to each of the address signals A0 through A7 for making each of the address signals A0 through A7 low when the display controller 4 is not operating.

The low power write circuit 21 comprises an inverter 213 and a delay circuit 214 and it inverts the access signal 201 outputted from the VRAM access detection circuit 20 by the inverter 213 when the access signal 201 goes low so as to make the low power enabling signal 202 serving as an output thereof high. The delay circuit 124 delays the write time needed for writing at least one frame of image data by a given time to make the stop signal 203 low to thereby stop the operation of the display controller 4.

However, when the display controller 4 stops its operation, the VRAM access detection circuit 20 detects the stop of operation of the display controller 4 so that the write operation of the image data is not performed for making the access signal high. Since the display controller 4 is again activated by the system controller 10 in FIG. 6 when a new display is needed, the VRAM access detection circuit 20 detects the reactivation of the display controller 4 to make the access signal low so that the image data can be again written.

Figure 8:
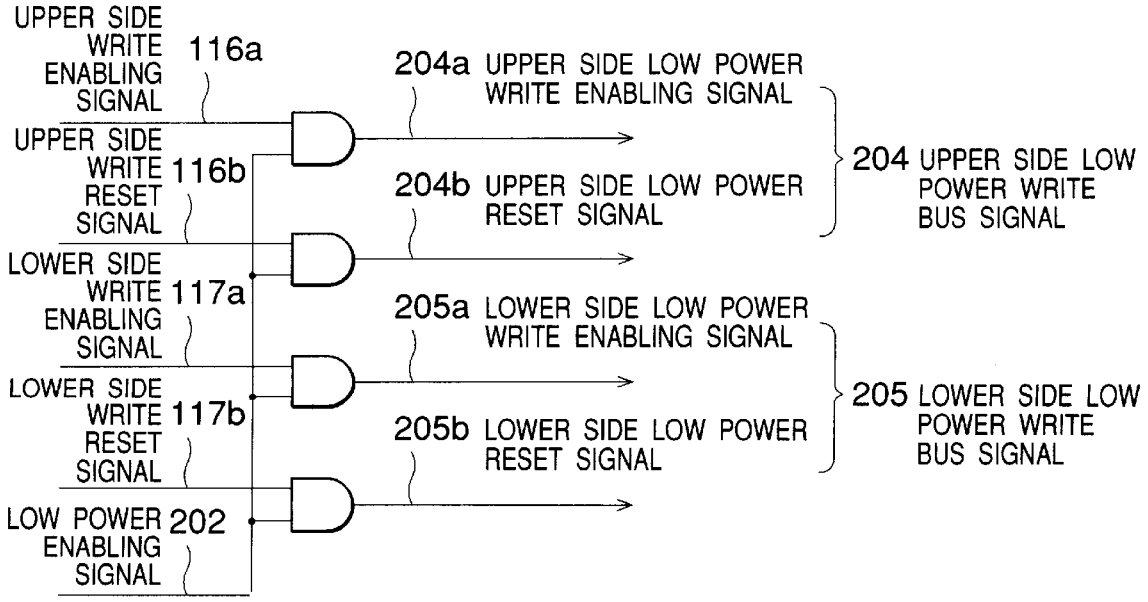
FIG. 8 is a circuit diagram showing a detailed write enabling restriction circuit in FIG. 6.

The write enabling restriction circuit 22 comprises four AND gates 221 through 224 shown in FIG. 8 wherein the AND gate 221 receives the upper side write enabling signal 116*a* as its one input, the AND gate 222 receives the upper side write reset signal 116*b* as its one input, the AND gate 223 receives the lower side write enabling signal 117*a* as its one input, the AND gate 224 receives the lower side write reset signal 117*b* as its one input, and the AND gates 221 through 224 receive the low power enabling signal 202 as their other input so that the signals 116*a*, 116*b*, 117*a*, 117*b* and the low power enabling signal 202 are ANDed.

Accordingly, when the low power enabling signal 202 is low, any of the AND gates 221 through 224 does not output the other input signal and all the outputs thereof stay low so that the upper and lower side low power write bus signals 204 and 205 are not outputted.

When the low power enabling signal 202 goes high, all the AND gates 221 through 224 output the other input signals. That is, the AND gate 221 outputs the upper side write enabling signal 116*a* as an upper side low power write enabling signal 204*a*, the AND gate 222 outputs the upper side write reset signal 116*b* as an upper side low power reset signal 204*b*, the AND gate 223 outputs the lower side write enabling signal 117*a* as a lower side low power write enabling signal 205*a* and the AND gate 224 outputs the lower side write reset signal 117*b* as a lower side low power reset signal 205*b*.

The upper side low power write enabling signal 204*a* and the upper side low power reset signal 204*b* constitute the upper side low power write bus signal 204, and the lower side low power write enabling signal 205*a* and the lower side low power reset signal 205*b* constitute the lower side low power write bus signal 205.

The image data are written when these signals are inputted into the upper and lower side memories 8 and 9 in FIG. 6 together with the upper side write data 118 or lower side write data 119 from the data select circuit 104.

According to the second embodiment, image data from the given display area in the upper and lower side image data 114 and 115, which are outputted from the display controller 4 only when the display controller 4 is operating, are equally divided into the upper and lower side write data 118 and 119 so that the upper and lower side write data 118 and 119 are respectively written and held in the upper and lower side memories 8 and 9, thereafter the operation of the display controller 4 is stopped to reduce the power consumption. Even after stop of the operation of the display controller 4, the image data held in the upper and lower side memories 8 and 9 are read out so as to be repeatedly displayed on the LCD 1 so that an equal-sized image or enlarged static image can be continuously displayed.

When it is necessary to change the display, the system controller 10 activates the display controller 4 so as to write new display data into the VRAM 5 so that the VRAM access detection circuit 20 detects the writing of the new display data and outputs the access signal 201 so as to start writing newly outputted new image data into the upper and lower side memories 8 and 9, which updates the displayed image.

In such a manner, when a system provided with the LCD device such as a personal computer is ready for key input, the power consumption can be reduced while continuing to enlargedly display the image from the given display area of the full-screen area on the full-screen area or part-screen area at the time when the last input is performed in the LCD 1.

The memory write controller 6 divides the image data from the given display area of a screenful of image data which is outputted from the display controller 4 into upper and lower write data, which are repeatedly written and held in the upper and lower side memories 8 and 9 during a period when write operation is enabled by the write enabling restriction circuit 22. The stop of operation of the display controller 4 may be performed by the system controller 10 when it is ready for, e.g. input.

As a result, the equal-sized image or the enlarged image can be displayed in real time on the LCD 1 during the operation of the display controller 4, and a static image from the full-screen area which is held lastly can be continuously displayed after the stop of operation of the display controller, e.g. when the system is ready for key input.

After the write operation is enlarged by the write enabling restriction circuit 22, the memory write controller 6 divides image data from the given display area of each full-screen area of the second and succeeding frames outputted from the display controller 4 into the upper and lower side write data to be written in the upper and lower side memories 8 and 9, which dispenses with holding of the unstable first frame image data from the first frame.

A third embodiment of the present invention will be described now wherein elements of the LCD device are substantially common to those of the first embodiment shown in FIG. 1 and the second embodiment shown in FIG. 6 so that the block diagram of the third embodiment is omitted.

The third embodiment is different from the first and second embodiments in respect of only an element corresponding to the display area determining circuit 101 of the memory write controller 6 (this element is also hereinafter referred to as the display area determining circuit 101).

In the first and second embodiments, one of a plurality of preset different display areas is selected using a logic circuit in accordance with a combination of the mode signals A and B so as to determine the selected area as the display area.

On the other hand, the display area determining circuit 101 of the third embodiment detects a cursor location in a screenful of image data outputted from the display controller 4 to automatically determine an area having a given range including the detected cursor location as the display area. Accordingly, the image from the given area including the cursor location representing that the system is ready for input is always displayed on the LCD, which is convenient in that the operator does not lose sight of the cursor even if the image is enlargedly displayed.

The function of this display area determining circuit 101 can be realized by the processing of the microcomputer in the control portion of the system or the display controller 4 even in the LCD device of FIG. 1 or FIG. 2.

Figure 9:
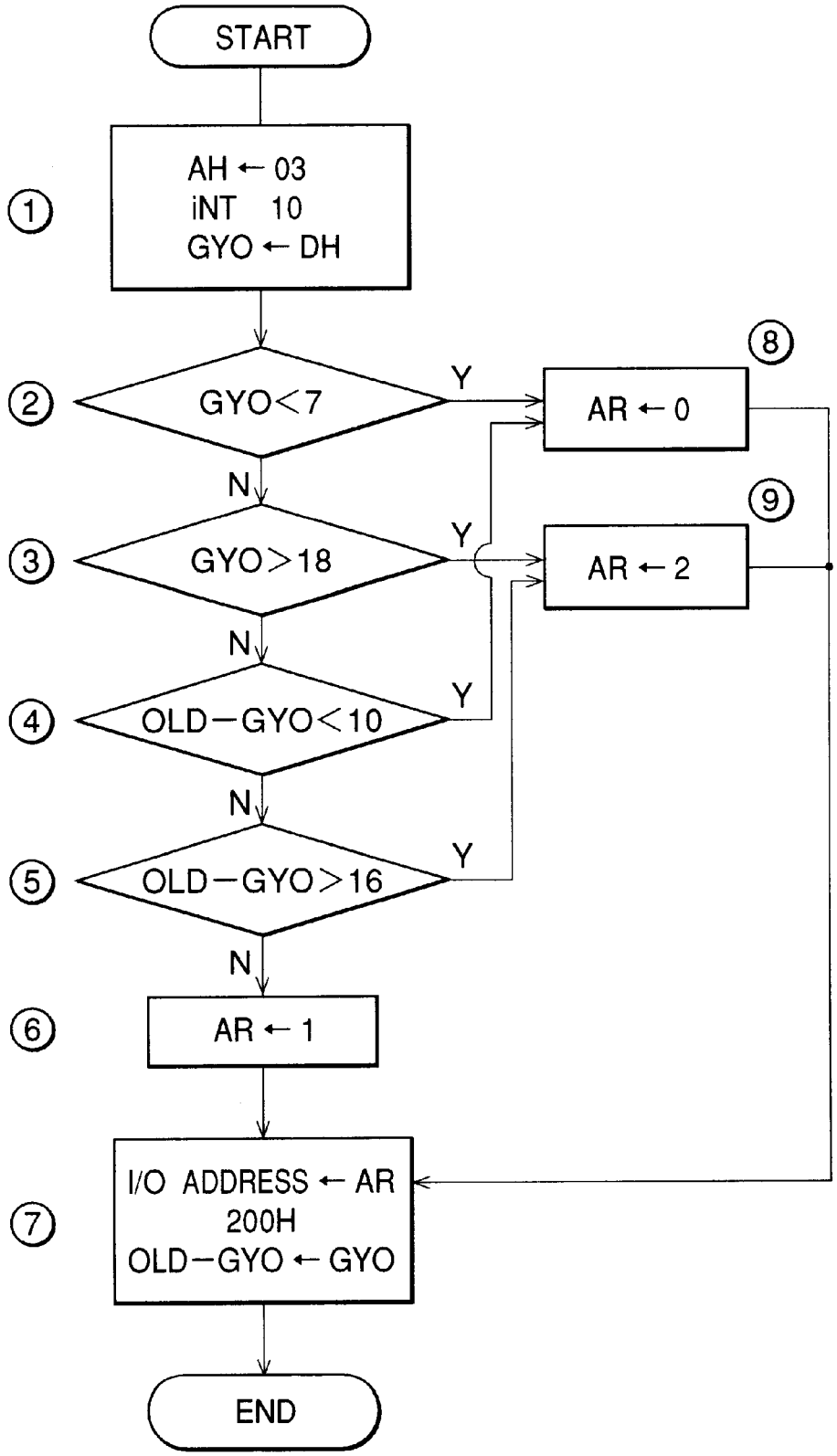
FIG. 9 is a flowchart showing the processing of a display area determining means according to a third embodiment of the present invention.

FIG. 9 is a flowchart showing the display area determining procedure or program in a text mode (80 by 25 character display).

Step 1 is a procedure for detecting the cursor location wherein an AH register is assigned with 03 so as to execute an interruption 10 H (10 in hexadecimal) which is a display service routine in a BIOS (Basic Input/Output system) so that the content of a DH register becomes a cursor display row. This content is entered into GYO (row variable).

Thereafter, the display area determining circuit 101 discriminates to which area the cursor location belongs based on the result of Steps 2 thorough 5. In Step 2, it is judged whether GYO is less than 7 or not (above the 7th row). If it is less than 7 in Step 2, the program goes to Step 8 where "0" is entered into AR (area variable), then goes to step 7.

If GYO is not less than 7 in Step 2, the program goes to Step 3 where the display area determining circuit 101 judges whether GYO exceeds 18 or not (below the 18th row). If it exceeds 18 in Step 3, the program goes to Step 9 where "2" is entered into the AR, then goes to Step 7.

If GYO does not exceed 18 in Step 3, the program goes to Step 4 where the display area determining circuit 101 judges whether OLD_GYO representing a previous cursor location row is less than 10 or not (above the 10th row). If it is less than 10 in Step 4, the program goes to Step 8 where "0" is entered in the AR, then the program goes to Step 7.

If OLD_GYO is not less than 10 in Step 4, the program goes to Step 5 where the display area determining circuit 101 judges whether OLD_GYO representing a previous cursor location row exceeds or not 16 (above the 16th row). If it exceeds 16 in Step 5, the program goes to Step 8 where "0" is entered into the AR, then the program goes to Step 7.

If OLD_GYO does not exceed 16 in Step 5, the program goes to Step 7 where "1" is entered into the AR, then the program goes to Step 7.

In Step 7, the area variable AR is outputted to an I/O address 200 H so as to terminate the procedure by changing the row variable GYO to OLD_GYO.

Whereupon, the output of the AR to the I/O address 200 H in Step 7 means that the content of the AR is outputted in response to the mode bus signal 123 in FIG. 1 or 6. In other words, it is equivalent that 1st through 100th image data lines become a display area when the AR is "0", the 21st through 120th image data lines become a display area when the AR is "1", and the 101st through 200th image data lines become a display area when the AR is "2".

If this program is to be executed by a periodic interruption procedure, the cursor display row is periodically detected so that the image from an optimum display area can be always enlargedly displayed on the full-screen area of a display.

In the third embodiment, the text mode cursor display is exemplified, however, it is possible to automatically determine the optimum display area by detecting the cursor location at the display location such as a mouse cursor in a graphic mode by a similar method.

The LCD device according to a fourth embodiment of the present invention will be now described.

Figure 10:
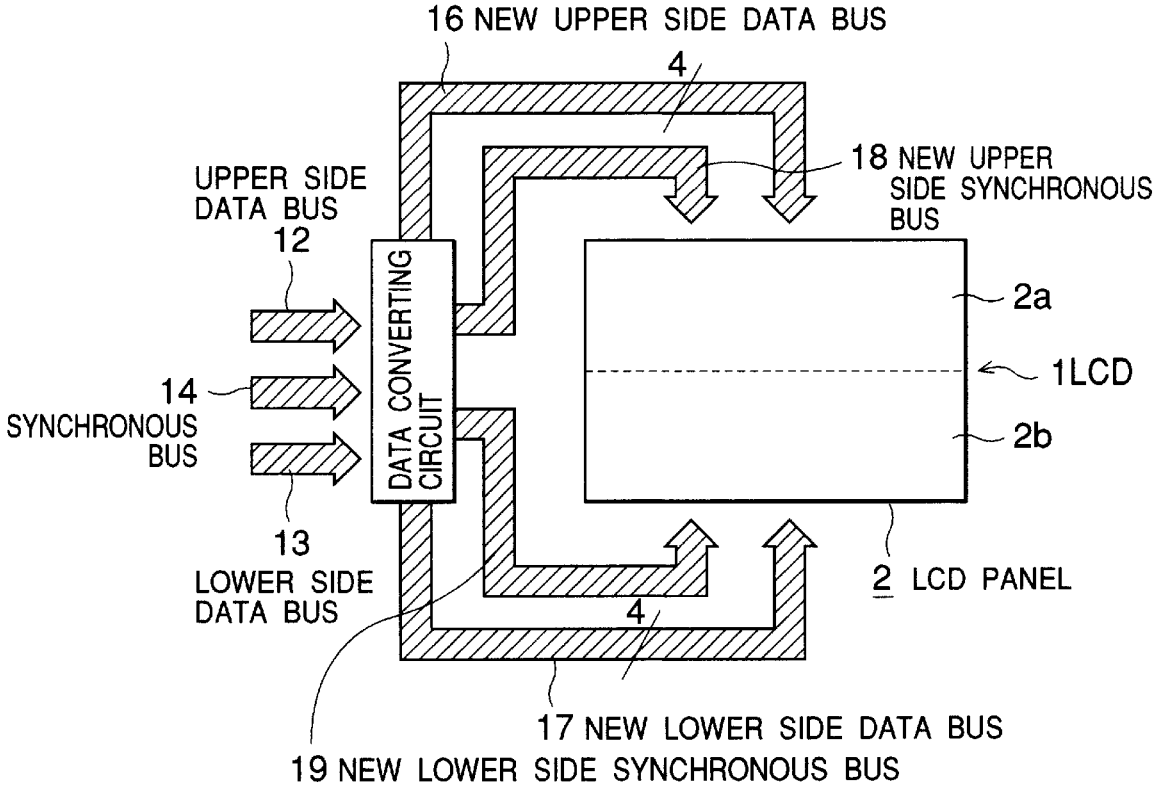
FIG. 10 is a schematic view showing only a main portion of an LCD according to a fourth embodiment.

FIG. 10 is a schematic view showing a main portion alone of the LCD device of the fourth embodiment.

The LCD 1 of this embodiment is also an LCD of vertically-divided driving system like the LCD 1 of the first through third embodiments and includes the LCD panel 2 capable of displaying the 400 lines of image data. Image data and synchronous signals are independently inputted into and displayed on the upper half portion 2*a* (200 lines) and the lower half portion 2*b* (200 lines) of the LCD panel 2 like the conventional LCD device shown in FIG. 14.

It is possible to carry out the enlarged display by changing the size of the display unit pixel by electrically connecting a plurality of display electrodes in parallel with each other for time-sharing matrix driving the liquid crystal pixels which are arranged as a matrix on the LCD panel 2.

According to the fourth embodiment, a data converting circuit (data converting means) 15 is provided between the upper and lower side data buses 12 and 13, a synchronous bus 14 and the LCD 1.

Image data from the given display area in the upper and lower image data, which are respectively inputted through the upper and lower side data buses 12 and 13 by the display controller 4, not shown, are converted into new upper and lower side image data so as to be independently inputted into the LCD 1 through new upper and lower side data buses 16 and 17 so as to enlargedly display the upper and lower half portions of the image data from the given display area of the full-screen area on the upper half portions 2*a* and 2*b* of the LCD panel 2 respectively.

A synchronous signal to be inputted through the synchronous bus 14 is likewise divided and converted into new upper and lower side synchronous signals by the data converting circuit 15, which signals are independently inputted into the LCD 1 through new upper and lower side synchronous buses 18 and 19.

For example, when the 21st through 220th image data lines in the 400 lines of image data of a full-screen area are enlargedly displayed on the full- screen area of the LCD panel 2, the 21st through 200th image data lines are inputted through the upper side data bus 12 and the 201st through 220th image data lines are inputted through the lower side data bus 13. However, these image data are equally divided and converted by the data converting circuit 15 into the new upper side image data (21st through 120th image data lines) and the new lower side image data (121st through 220th image data lines) which are independently inputted into the LCD 1 through the new upper and lower side data buses 16 and 17.

In this case, although the 21st through 120th image data lines outputted through the upper side data bus 12 are outputted to the new upper bus 16 as they are, the 121st through 200th image data lines outputted through the upper side data bus 12 and the 201st through 220th image data lines outputted through the lower side data bus 13 must be outputted to the new lower side data bus 17, which requires switching between the upper and lower side data buses 12 and 13 during the scanning of the LCD. Accordingly, the synchronous signal of the lower side synchronous bus 19 must be shifted in timing relative to that of the upper side synchronous bus 18 for an appropriate period.

Figure 11:
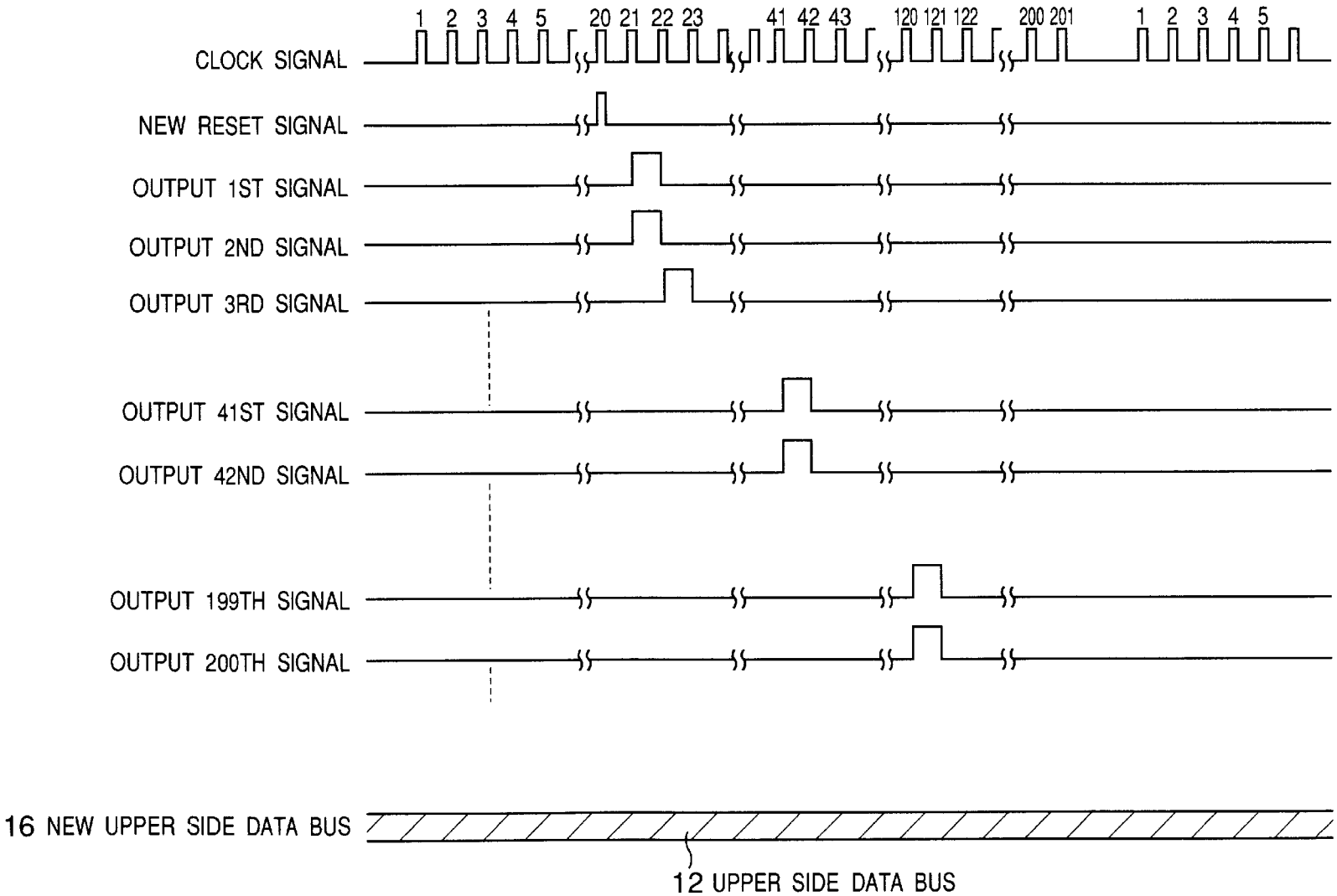
FIGS. 11 and 12 are timing charts of signals for upper and lower side display areas according to a fourth embodiment.

FIG. 11 is a timing chart of signals operating on the upper side display area when the 21st and succeeding image data are enlargedly displayed double.

Output 1st through 200th signals are signals showing output timings of the 1st through 200th image data lines to be displayed on the upper half portion 2*a* of the LCD panel 2, wherein the same image data are displayed two by two at the same timing.

A new reset signal is a signal which is produced in synchronization with the 20th clock signal for scanning the 20th image data. The output 1st and 2nd signals are outputted at the same time in synchronization with the rise of the 21st clock signal.

The output 41st and 42nd signals are outputted at the same time in synchronization with the rise of the 41st clock signal while outputting the output odd numbered and even numbered nth signals at the same time. The succeeding signals are successively outputted until the output 199th and 200th signals are outputted at the same time in synchronization with the rise of the 120th clock signal.

In this case, the 21st through 120th image data lines are enlargedly displayed double in the vertical direction. The new upper side data bus 16 always remains the same as the upper side data bus 12. Output waveforms in FIG. 11 are omitted for simplifying the same figure although they are practically all of a/c driving waveforms to prevent deterioration of the LCD.

Figure 12:
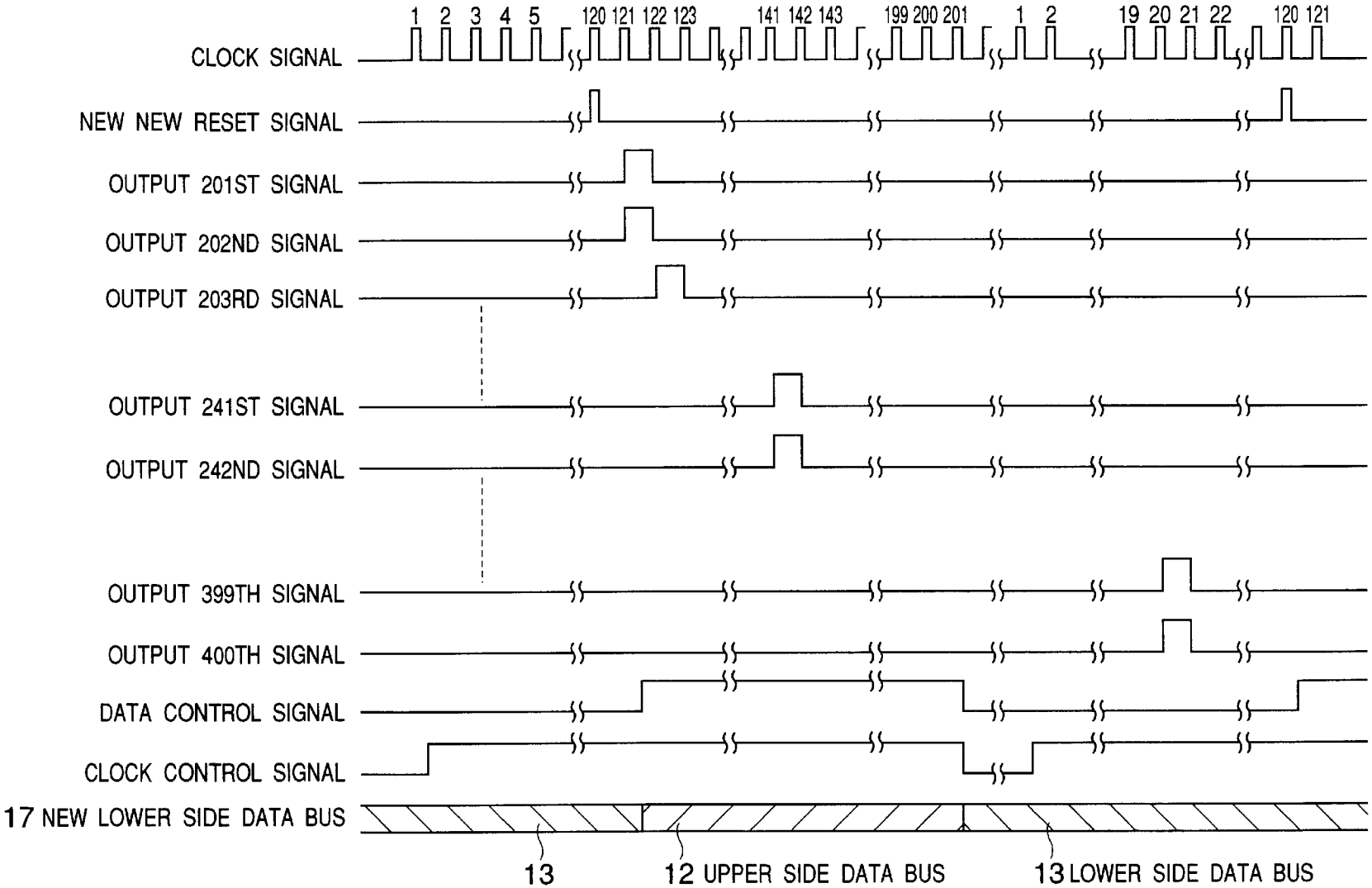

FIG. 12 is a timing chart of signals for the lower side display area when the 121st and succeeding image data lines are enlargedly displayed double.

Output 201st through 400th signals are signals showing output timings of the 201st through 400th image data lines to be displayed on the lower half portion 2*b* of the LCD panel 2, wherein the same image data are displayed two by two at the same timing.

A new new reset signal uses the 120th clock signal as a reset signal based on the reset signal, described later in FIG. 13. The output 201st and 202nd signals are outputted at the same time in synchronization with the rise of the 121st clock signal based on the new reset signal. The output 241st and 242nd signals are outputted at the same time in synchronization with the rise of the 141st clock signal while outputting the output odd-numbered and even-numbered nth signals at the same time. The succeeding signals are successively outputted until the output 399th and 400th signals are outputted at the same time in synchronization with the rise of the 20th clock signal.

A data control signal is a signal for switching between the upper and lower side data buses 12 and 13, and it goes high when the 121st clock signal rises based on the new new reset signal and the clock signal, and goes low when the 201st clock signal rises. A clock control signal is a signal for controlling an input clock signal, and it goes high when the 121st clock signal rises based on the reset signal, described later, and goes low when the 201st signal rises. The new lower side data bus 17 remains the same as the upper side data bus 12 when the data control signal is low and is made the same as the lower side data bus 13 when the data control signal is high.

Figure 13:
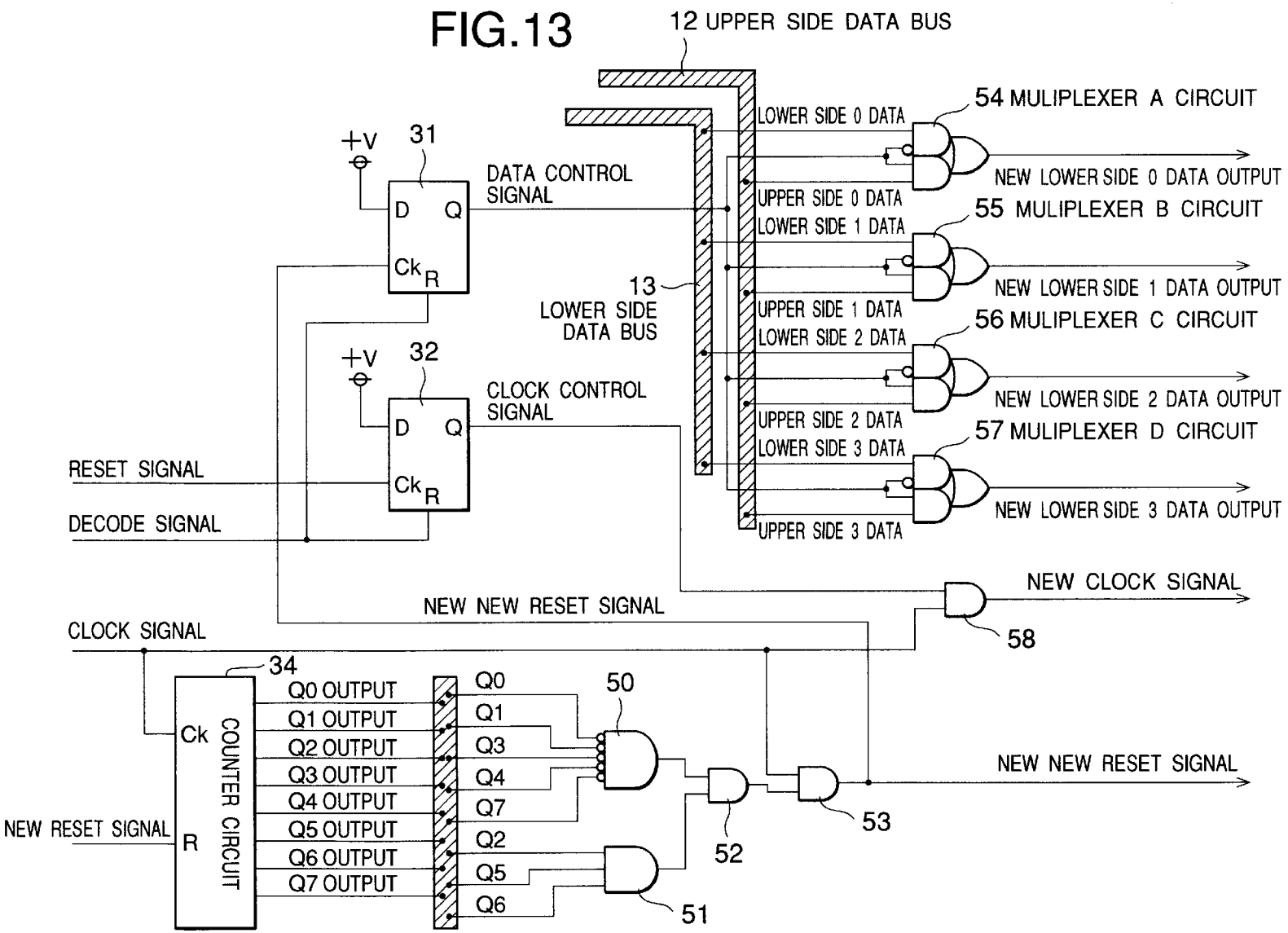
FIG. 13 is a circuit diagram showing details of a data converting circuit in FIG. 10.

FIG. 13 is a circuit diagram showing a detailed example of a driving portion of the data converting circuit 15 in FIG. 10 for the lower side display.

A counter circuit 34 is an ordinary binary counter for receiving the clock signal and the aforementioned new reset signal as its reset signal. The counter circuit 34 has 8 terminal outputs in total ranging from Q0 through Q7 outputs and it can count input clocks ranging from 0 through 255. Negative logic input AND gates 50 through 52 are output decoders of the counter circuit 34 and detect that the Q2 output (4 counter), the Q5 output (32 counter) and the Q6 output (64 counter) are high and the other terminals are low.

An AND gate 53 receives an output of the AND gate 52, and a clock signal which are ANDed to thereby detect the 120th clock signal. A clock signal outputted from the AND gate 53 becomes the new new reset signal.

A DFF (D-type flip-flop circuit ) 31 outputs a data control signal which goes high when the new new reset signal rises and goes low when a decode signal rises. Whereupon, the decode signal is an output which goes high when the 201st clock signal is detected by a decoding portion, not shown, like the new new reset signal.

A DFF 32 outputs a clock control signal which goes high when the reset signal rises and goes low when the decode signal rises.

A multiplexer A circuit 54 outputs a lower side 0 data as a new lower side 0 data when the data control signal is low and outputs an upper side 0 data as a new lower side 0 data when the data control signal is high.

Likewise, multiplexer B, C and D circuits 55, 56 and 57 output lower side 1st through 3rd data as new lower side 1st through 3rd data when the data control signal is low and output upper side 1st through 3rd data as the new lower side 1st through 3rd data when the data control signal is high.

An AND gate 58 receives the clock control signal and the clock signal which are ANDed to thereby produce a new clock signal.

Enlarged display can be performed in the manner as mentioned above. Although the enlarged display of the 21st through 220th image data lines is explained in the fourth embodiment, a similar circuit for switching the new upper side data bus 16 is needed when enlargedly displaying the 101st and succeeding image data lines on a full-screen area of a display based on the new reset signal.

For example, when enlargedly displaying the 120th and succeeding image data lines on a full-screen area of a display, the new upper side data bus 16 must still transmit the 121st through 220th image data lines so that the upper and lower side data buses 12 and 13 must be switched therebetween during scanning of the LCD. In this case, the new lower side data bus 17 remains in the same state as the lower side data bus 13. Further, the reset signal for the lower side display remains to be the new new reset signal.

According to the fourth embodiment, since the clock frequency is made low when performing enlarged display, the power consumption is reduced. It is possible to enlargedly display the image with high quality while the image is not discontinuous at a boundary between the upper and lower half portions of the LCD of the vertically-divided driving system.

Furthermore, it is also possible, in the fourth embodiment, to arbitrarily select and determine the given display area of the full-screen area to be enlargedly displayed on the full-screen area from a plurality of predetermined different display areas based on a combination of mode signals and dip switches, etc.

Still furthermore, it is possible to detect a cursor location in an image data area from a full-screen area of display outputted from the display controller using a microcomputer in a system control portion, not shown, or the display controller so as to automatically determine the area having a given range including the detected cursor location as the display area.

What is claimed is:

1. An LCD device comprising:

an LCD having time-sharing matrix driving liquid crystal pixels arranged as a matrix in upper and lower half portions, for display of an initial screenful of image data made up of upper and lower side image data in a display area;

a display controller respectively displaying the upper and lower side image data on the upper and lower half portions of the LCD;

an upper side image data-holding memory holding the upper side image data;

a lower side image data-holding memory holding the lower side image data;

memory write control means for identifying a selected continuous portion of the initial screenful of image data for enlargement and dividing the selected continuous portion of the initial screenful of image data into new upper and lower side image data respectively written and held in the upper and lower side image data-holding memories; and memory read control means for reading out the new upper and lower side image data held in the upper and lower side memories to be repeatedly displayed by the display controller on the upper and lower half portions of the LCD as a new screenful of image data in which a plurality of display electrodes of the pixels are connected in parallel to achieve an enlargement of the selected continuous portion of the initial screenful of image data.

2. An LCD device according to claim 1, wherein the memory write control means comprises:

display area determining means for identifying the selected continuous portion of the initial screenful of image data from the display area;

write reference determining means for determining a write reference in response to synchronous signals outputted from the display controller;

write means for controlling the upper and lower side image data-holding memories in response to output signals from the write reference determining means and display area determining means; and select means for selecting the upper and lower side image data outputted from the display controller in response to output signals from the display area determining means to output the new upper and lower side image data to be respectively written in the upper and lower side image data-holding memories.

3. An LCD device according to claim 2, wherein the display area determining means selects at least one of different display areas which were previously set in response to inputted mode signals so as to determine a selected display area as the selected continuous portion of the initial screenful of image data in the display area.

4. An LCD device according to claim 2, wherein the display area determining means detects a cursor location in the initial screenful of image data to determine an area having a given range including the detected cursor location as the selected continuous portion of the initial screenful of image data in the display area.

5. An LCD device according to claim 1, wherein the memory read control means includes means for outputting a memory read latch pulse signal and a memory read clock signal to the upper and lower side image data-holding memories, wherein the memory read latch pulse signal and the memory read clock signal are divided in frequency in accordance with the plurality of parallel connections of the display electrodes for time-sharing matrix driving the liquid crystal pixels of the LCD.

6. An LCD device according to claim 1, further comprising:

means for detecting whether the display controller is operating or not, and write enabling restriction means for permitting the memory write control means to write only when the detection means detects operation of the display controller;

wherein the memory write control means repeatedly reads out the upper and lower side image data held in the upper and lower side image data-holding memories to be repeatedly displayed on the upper and lower half portions of the LCD respectively when at least the detection means detects that the display controller is not operating.

7. An LCD device according to claim 6, wherein the memory write control means divides the selected continuous portion of the initial screenful of image data into the new upper and lower side image data when a writing operation is enabled by the write enabling restriction circuit.

8. An LCD device according to claim 6, further comprising means for permitting the write enabling restriction circuit to enable the memory write control means to perform a writing operation when the detection circuit detects that the display controller is operating, and for stopping operation of said display controller after the memory write control means completes writing of the image data from the given area.

9. An LCD device comprising:

an LCD having time-sharing matrix driving liquid crystal pixels arranged as a matrix in upper and lower half portions, for display of an initial screenful of image data made up of upper and lower side image data;

a display controller respectively displaying the upper and lower side image data on the upper and lower half portions of the LCD; and data converting means for dividing and converting a selected continuous portion of the initial screenful of image data into new upper and lower side image data to be respectively displayed by the display controller on the upper and lower half portions of the LCD as a new screenful of image data in which a plurality of display electrodes of the pixels are connected in parallel to achieve an enlargement of the selected continuous portion of the initial screenful of image data.

10. An LCD device according to claim 9, further comprising a display area determining circuit for selecting at least one of different display areas which were previously set in response to inputted mode signals so as to determine the selected display area as the given continuous display area.

11. An LCD device according to claim 9, further comprising a display area determining circuit for detecting a cursor location in the screenful of image data output from the display controller to determine an area having a given range including the detected cursor location as the given continuous display area.

* * * * *